US009979098B2

(12) United States Patent
Lyon et al.

(10) Patent No.: US 9,979,098 B2
(45) Date of Patent: May 22, 2018

(54) ELECTRICAL CONNECTOR

(71) Applicant: Pilkington Group Limited, Nr. Ormskirk Lancashire (GB)

(72) Inventors: Michael Lyon, Ormskirk (GB); Julie Houghton, St Helens (GB)

(73) Assignee: PILKINGTON GROUP LIMITED, Lancashire (GB)

( * ) Notice: Subject to any disclaimer, the term of this patent is extended or adjusted under 35 U.S.C. 154(b) by 1 day.

(21) Appl. No.: 15/023,136

(22) PCT Filed: Sep. 19, 2014

(86) PCT No.: PCT/GB2014/052859

§ 371 (c)(1),
(2) Date: Mar. 18, 2016

(87) PCT Pub. No.: WO2015/040417

PCT Pub. Date: Mar. 26, 2015

(65) Prior Publication Data

US 2016/0294071 A1 Oct. 6, 2016

(30) Foreign Application Priority Data

Sep. 20, 2013 (GB) ..... 1316779.6

(51) Int. Cl.
*H01R 4/02* (2006.01)
*H01R 4/48* (2006.01)
(Continued)

(52) U.S. Cl.
CPC ..... *H01R 4/02* (2013.01); *H01R 4/48* (2013.01); *H01R 4/54* (2013.01); *H01R 4/56* (2013.01);
(Continued)

(58) Field of Classification Search
CPC ... H01R 4/02; H01R 4/48; H01R 4/54; H01R 4/56; H01R 43/02; H01R 43/0256; H05B 3/84; H05B 2203/016; H05B 2203/017
(Continued)

(56) References Cited

U.S. PATENT DOCUMENTS 4,440,464 A 4/1984 Spinner
5,232,383 A 8/1993 Bernick
(Continued)

FOREIGN PATENT DOCUMENTS

CA 2 449 182 A1 5/2005
DE 30 22 102 C1 11/1981
(Continued)

OTHER PUBLICATIONS

International Search Report (PCT/ISA/210) dated Nov. 21, 2014, by the Japanese Patent Office as the International Searching Authority for International Application No. PCT/GB2014/052859.
(Continued)

*Primary Examiner* — Khiem Nguyen
(74) *Attorney, Agent, or Firm* — Buchanan Ingersoll & Rooney PC

(57) ABSTRACT

An electrical connector used to make electrical connection to a heating system or to an antenna system on a glazing comprises a substantially planar foot, suitable for soldering, an angled portion, permanently connected to the foot and substantially at right angles to the plane of the foot and a holding portion, connected to the angled portion and suitable for holding a cable, wherein the foot has a substantially circular or oval shape. A glazing comprising such an electrical connector further comprises a sheet of glazing material, an electrical conductor on a surface of the sheet of glazing material and a solder layer between the electrical conductor and the foot wherein the solder layer comprises
(Continued)

lead-free solder. The angled portion may be a male portion of a button connector, also known as a snap connector. The holding portion may be a washer soldered or welded to the angled portion.

18 Claims, 10 Drawing Sheets

(51) Int. Cl.
*H05B 3/84* (2006.01)
*H01R 4/00* (2006.01)
*H01R 4/56* (2006.01)
*H01R 43/02* (2006.01)

(52) U.S. Cl.
CPC ..... *H01R 43/02* (2013.01); *H05B 3/84* (2013.01); *H05B 2203/016* (2013.01); *H05B 2203/017* (2013.01)

(58) Field of Classification Search
USPC ..... 439/83, 874, 876
See application file for complete search history.

(56) References Cited

U.S. PATENT DOCUMENTS

| | | | |
|---|---|---|---|
| 6,267,630 | B1 | 7/2001 | Machado |
| 7,909,665 | B2 | 3/2011 | Lyon |
| 2005/0118853 | A1 | 6/2005 | Starke et al. |
| 2005/0239311 | A1 | 10/2005 | Yokoigawa et al. |
| 2007/0224842 | A1 | 9/2007 | Hoepfner et al. |

FOREIGN PATENT DOCUMENTS

| | | |
|---|---|---|
| EP | 1 589 619 A1 | 10/2005 |
| FR | 2 963 311 A1 | 2/2012 |

OTHER PUBLICATIONS

Written Opinion (PCT/ISA/237) dated Nov. 21, 2014, by the Japanese Patent Office as the International Searching Authority for International Application No. PCT/GB2014/052859.

ELECTRICAL CONNECTOR

BACKGROUND OF THE INVENTION

The invention relates to an electrical connector used, for example to make electrical connection to a heating system or to an antenna system on a glazing, and a method of manufacturing a glazing.

Electrical connectors are known which make an electrical connection between a cable and a conductive element on a vehicle glazing. For example, a T-piece connector is used to connect a heating circuit or antenna on a vehicle glazing to the wiring harness of a vehicle. The T-piece comprises at least two feet which are soldered to a conductive element, such as a busbar, on the vehicle glazing. The feet are connected to the busbar using a conventional solder, containing lead.

A known problem with such conventional solder is unacceptable concentrations of lead in waste electrical equipment recycling, especially related to end of life vehicles. High lead concentration in water supplies can cause lead poisoning of people and the environment. Therefore it is desirable to use a lead-free solder in combination with conventional T-pieces, but this combination has less advantageous mechanical properties, which may lead to breakage of glass in the region of the solder. Thermal cycling in a vehicle can cause premature failure of such an electrical connection. A solder joint of this combination is unreliable therefore it is desirable to find an alternative design of T-piece connector.

U.S. Pat. No. 7,909,665 (Pilkington/Lyon) solves the problem of reliability of the solder joint between a T-piece connector and a busbar, wherein the T-piece has a connector bridge, of height "h" above the feet, and the feet have protrusions, of height "d" in the direction of the glass. A more reliable solder joint is obtained by optimising "d" and "h" in combination with lead-free solder.

It is an object of the present invention to provide an alternative electrical connector with improved reliability of lead-free solder joint and fewer breakages of glass in the region of the solder after thermal cycling.

SUMMARY OF THE INVENTION

According to a first aspect of the present invention, an electrical connector is provided comprising the features set out in claim 1 attached hereto.

According to a second aspect of the present invention, a method of manufacturing a glazing is provided comprising the steps set out in claim 17 attached hereto.

The present invention offers an alternative electrical connector which, when attached to an electrical conductor on a sheet of glazing material by means of a lead-free solder, provides a durable product, capable of withstanding thermal cycling tests required for vehicle glazing.

A benefit is achieved by providing a substantially circular foot permanently connected to an angled portion, substantially at right angles to the foot, and connecting the foot to an electrical conductor on a sheet of glazing material by means of a layer of lead-free solder. In particular, breakages of the glass in the vicinity of the lead-free solder are significantly reduced by the invention.

Surprisingly, the inventors have found that provision of a substantially circular foot and an angled portion reduces the number of breakages due to thermal stresses, which the connector is likely to encounter in service. Data from a thermal cycling test is evidence of this benefit. An electrical connector according to the invention comprising one circular foot causes fewer glass breakages than a standard T-piece connector comprising two rectangular feet, when using lead-free solder in a thermal cycling test.

An advantage of the invention is that the benefit of improved adhesion with lead-free solder due to a substantially circular foot permanently connected to an angled portion is combined with the benefit of connectivity due to the holding portion. Advantageous embodiments include a holding portion in the shape of a spade connector suitable for a releasable connection. Alternatively, the holding portion in the shape of a ledge or a washer allows a cable to be permanently soldered in position.

BRIEF DESCRIPTION OF THE DRAWINGS

The invention will now be described by means of non-limiting examples with reference to the attached figures.

DETAILED DESCRIPTION OF THE INVENTION

Figure 1:
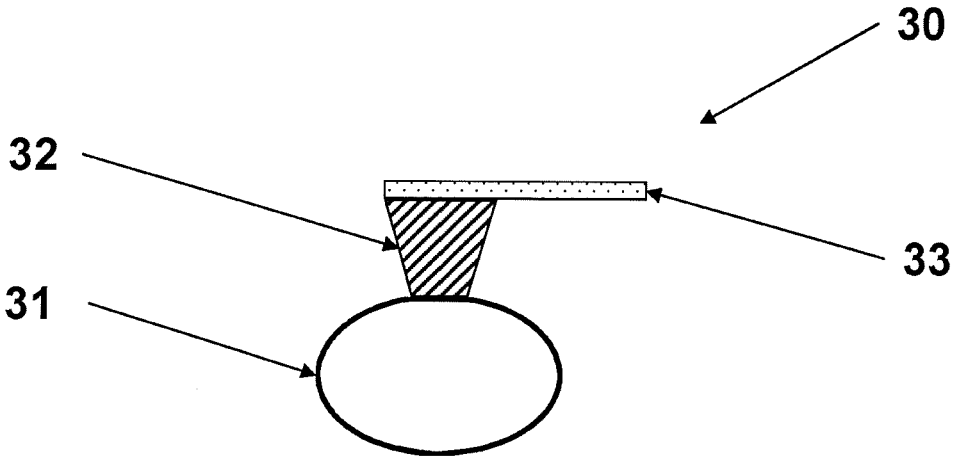
FIG. 1 shows an electrical connector according to the invention in plan view.
Figure 2:
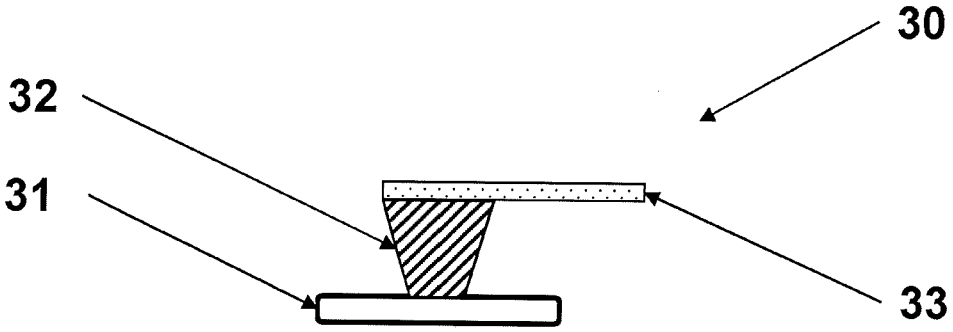
FIG. 2 shows an electrical connector according to the invention in side view.

According to the invention from a first aspect, an electrical connector is provided. FIG. 1 shows an electrical connector 30 according to the invention comprising a foot 31 permanently connected to an angled portion 32. FIG. 2 shows that foot 31 is substantially planar and that the angled portion is substantially at right angles to the plane of the foot 31.

The shape of the foot 31 is substantially circular or oval. Substantially circular includes circular but with a chord defining a portion of the circular perimeter which is a straight edge. This would be the case, for example, if the foot and the angled portion are made from one piece of sheet metal with a fold.

The shape of the foot 31 may also be oval shape. The shape of the foot 31 may not be crescent shape, where crescent shape is defined as having perimeter portions wherein the radius of curvature is more than five times other perimeter portions.

FIG. 1 and FIG. 2 show a holding portion 33 connected to the angled portion 32. The holding portion 33 is suitable for holding a cable. Cable holding may be permanent, for example by directly soldered, or may be releasable, for example a male portion spade connector and the cable is terminated in a female portion of a spade connector.

The shape of the angled portion 32 and the holding portion 33 may be planar. In an advantageous embodiment, the foot 31, the angled portion 32 and the holding portion 33 are stamped from a single sheet of metal. The angled portion 32 is a strip narrower than the diameter of the foot 31. The holding portion 33 is the width of a spade connector and is formed at right angles to the angled portion 32. The angled portion is then folded to be at right angles to the plane of the foot 31.

Figure 5:
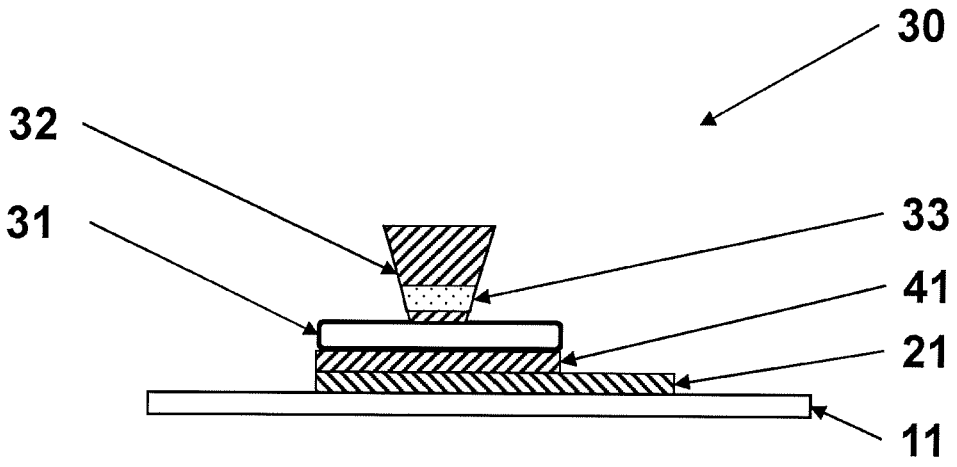
FIG. 5 shows a glazing, with holding portion at the base of an angled portion.
Figure 6:
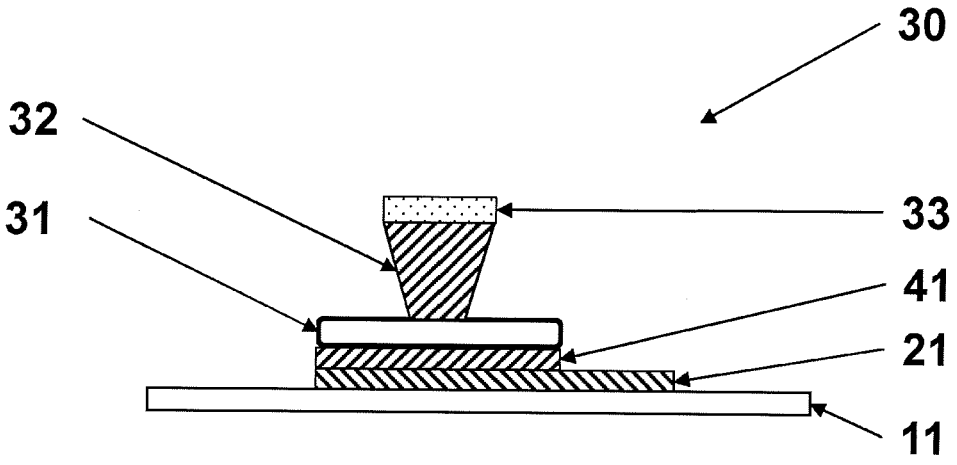
FIG. 6 shows a glazing, with a holding portion at the top of an angled portion.

In an advantageous embodiment, the angled portion 32 has a substantially cylindrical shape. The holding portion 33 may be at the base of the angled portion 32 as shown in FIG. 5. Alternatively the holding portion 33 may be at the top of the angled portion 32 as shown in FIG. 6. 'Substantially cylindrical' includes an angled portion 32 having a cylindrical conical shape, due to top and bottom ends having different diameters, as shown in FIG. 5 and FIG. 6.

Figure 7:
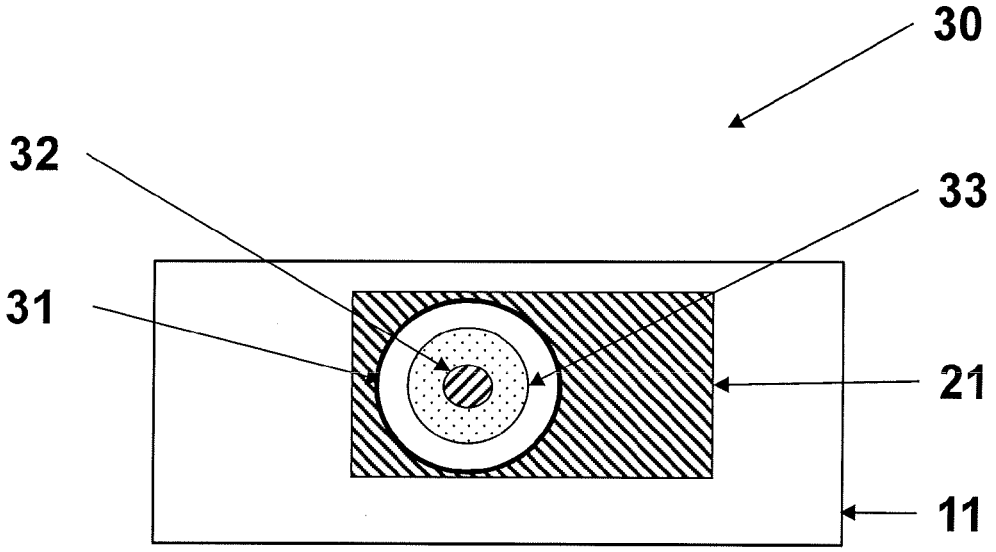
FIG. 7 shows a plan view of a glazing, with a washer as a holding portion.
Figure 8:
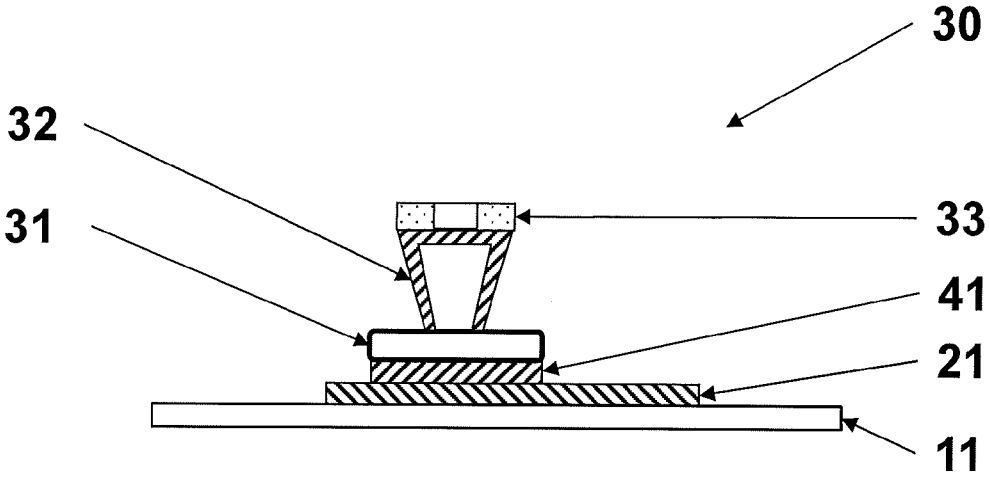
FIG. 8 shows a side cross-section of the glazing of FIG. 7.

In a further embodiment, shown in plan view FIG. 7 and side view cross-section FIG. 8, the holding portion 33 is a washer soldered to the angled portion 32. The inner diameter of the washer may be larger than the outer diameter of the cylindrical angled portion 32, so that the washer may be positioned freely between the base and the top of the angled portion 32. The holding portion 33 comprising a washer may be welded to the angled portion 32. Welding is an advantageous alternative to soldering because a holding portion 33 remains welded to an angled portion 32 during a soldering process for attaching a cable, so positioning the cable on the holding portion is made easier.

Figure 9:
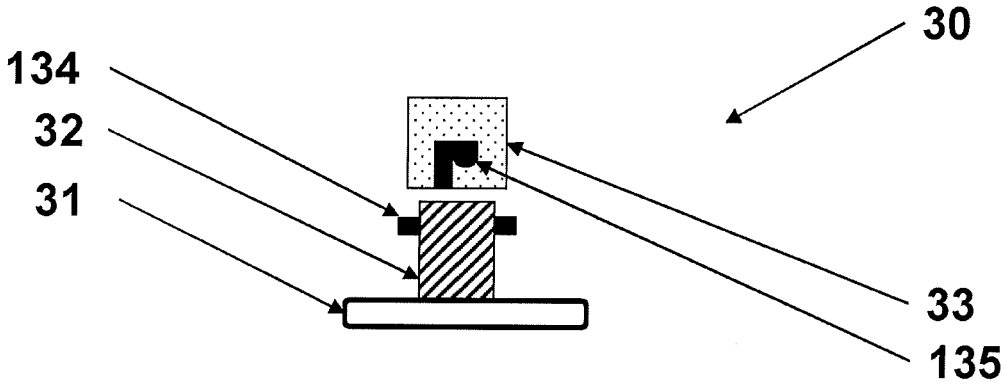
FIG. 9 shows a bayonet style connector, according to the invention.

The angled portion 32 and the holding portion 33 may be male and female portions of known connector types. Selecting a bayonet connector type, as in FIG. 9, the angled portion 32 is a male portion of a bayonet connector comprising plurality of studs 134 arranged on the outer surface of the angled portion 32, and the holding portion 33 is a female portion of a bayonet connector type comprising a plurality of slots 135 for retaining the studs 134.

Figure 10:
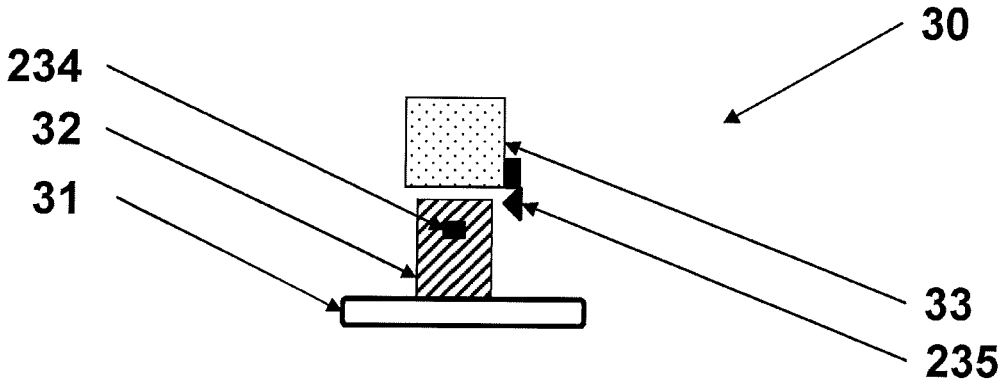
FIG. 10 shows a button connector having a hook, according to the invention.

Modifying a known button connector type, as in FIG. 10, the angled portion 32 may be configured as a male portion, further comprising a plurality of holes 234 in the outer surface of the angled portion 32, and the holding portion 33 may be configured as a female portion, further comprising a plurality of hooks 235. Hooks 235 deform elastically when pushed over the holding portion 33 and the hooks 235 spring into the holes 234 to lock male and female portions in position.

Figure 11:
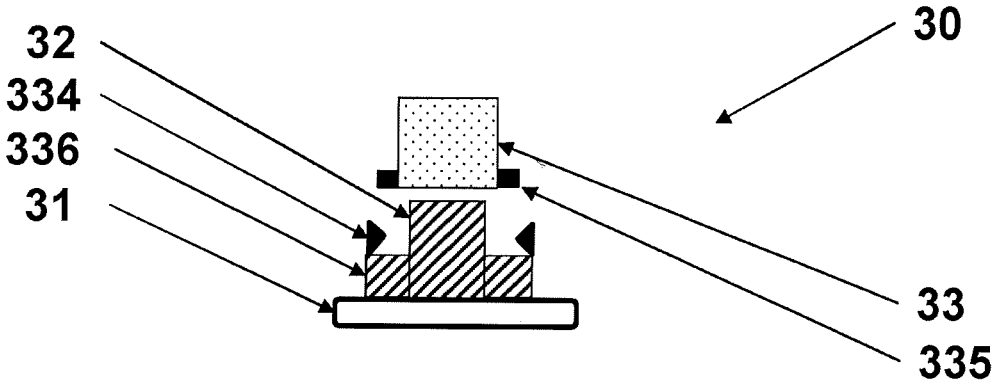
FIG. 11 shows a connector having an external ring.

In an alternative modification to a known button connector type, as in FIG. 11, the angled portion 32 is a male portion and further comprises an external ring 336 comprising a plurality of hooks 334, and the holding portion 33 is a female portion and further comprises a lip 335 for locating under the hooks 334. Hooks 334 deform elastically when the holding portion 33 is pushed onto them and the hooks spring over the lip 335 to lock male and female portions in position.

Figure 12:
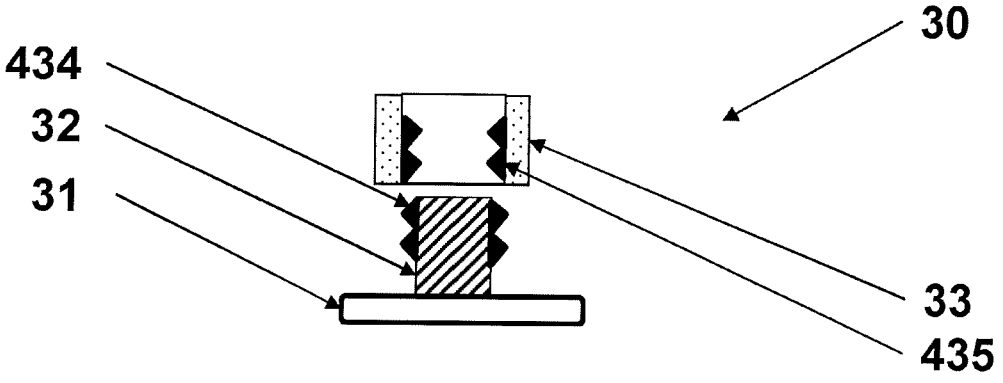
FIG. 12 shows a connector having a screw thread.

Selecting a screw connector type, as in FIG. 12, the angled portion 32 is a male portion of a screw connector and further comprises a screw thread 434, and the holding portion 33 is a female portion of a screw connector and further comprises a screw thread 435. A diameter of the angled portion 32 can be less than a diameter of the holding portion 33, so the screw threads 434, 435 are arranged on the outer surface of the angled portion 32 and inner surface of the holding portion 33. Vice-versa the diameter of the angled portion 32 can be greater than the diameter of the holing portion 33, so the screw threads 434, 435 are arranged on the inner surface of the angled portion 32 and the outer surface of the holding portion 33.

Figure 13:
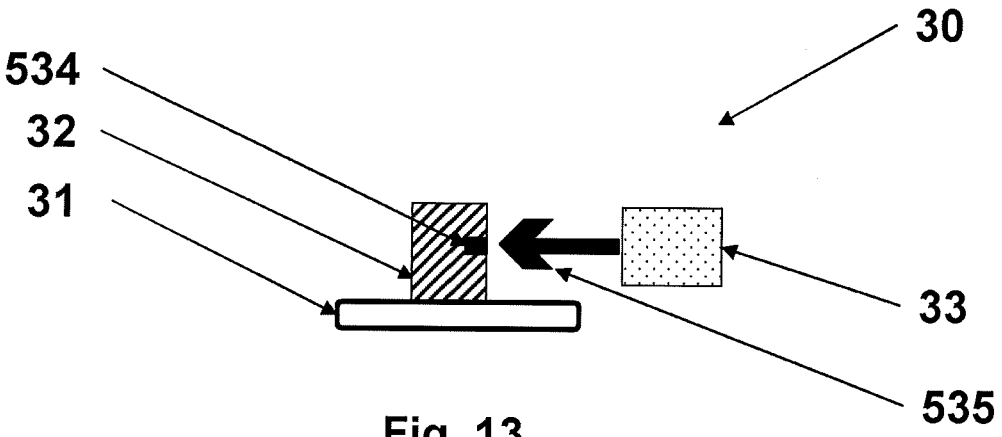
FIG. 13 shows a connector having a spring clip.

In an advantageous embodiment, as in FIG. 13, the angled portion 32 comprises a slot 534, and the holding portion 33 comprises a spring clip 535 for locating in the slot 534. As the holding portion 33 is pushed into the slot 534 in the angled portion 32, the spring clip 535 deforms elastically. When the holding portion 33 has passed through the slot 534, the spring clip 535 springs behind the slot 534 and locks the holding portion 33 to the angled portion 32.

Figure 14:
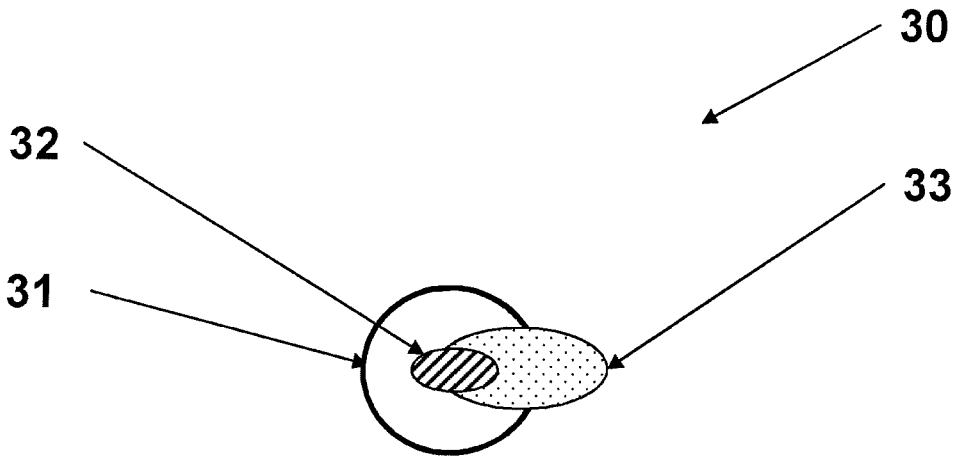
FIG. 14 shows a connector having an oval shape.

In a further embodiment, as in FIG. 14, the angled portion 32 has a substantially oval shape and the holding portion 33 has a recess corresponding to a narrow end of the oval shape. This embodiment provides unidirectional connection, so it is easier to align the holding portion 33 with the angled portion 32. A sliding action in a direction defined by a long axis of the oval shape simultaneously locates the holding portion 33 and clamps a cable between the holding portion 33 and the angled portion 32. A hook on the holding portion 33 elastically deforms during the sliding action and springs into a hole in the angled portion 32 to lock the holding portion 33 to the angled portion 32 and thereby to clamp the cable firmly.

Figure 15:
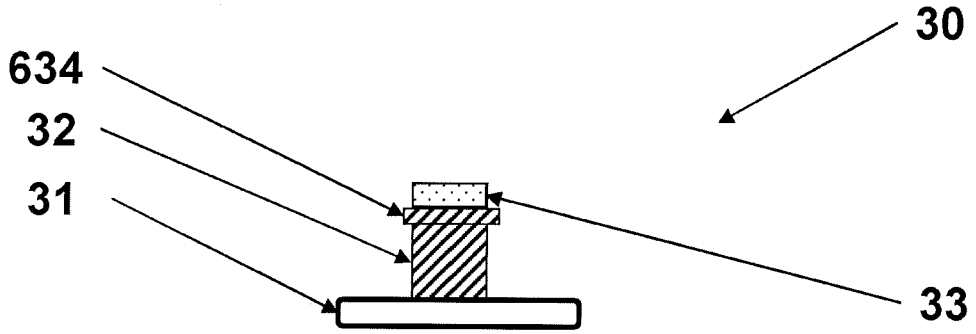
FIG. 15 shows a connector having a ledge.
Figure 16:
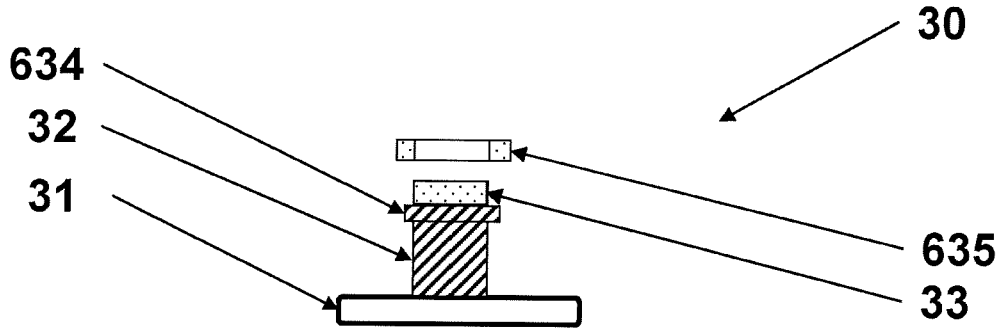
FIG. 16 shows a connector having a ledge and a washer.

In another embodiment, as in FIG. 15, the angled portion 32 further comprises a ledge 634 to define a position of the holding portion 33. A cable soldered to the holding portion 33 directly above the ledge 634 exerts a force via the holding portion 33 at a predetermined distance from the foot 31, so a predetermined lever effect is not exceeded. In FIG. 16, a washer 635, having an inner diameter larger than the holding portion 33, fits over the holding portion 33 and rests on the ledge 634, thereby accurately positioning the washer 635 horizontally and vertically. Accurate positioning improves soldering or welding of the washer 635 to the holding portion 33.

In an advantageous embodiment, a special case of FIG. 5 and FIG. 6, the angled portion 32 is a male portion of a button connector, having a cylindrical conical shape, wherein a part of the angled portion 32 close to the foot 31 is not as wide as a part of the angled portion 32 remote from the foot 31 and the holding portion 33 is permanently connected to the angled portion 32. This embodiment uses a male portion of a known button connector but, surprisingly, part of the male portion is used as the holding portion 33. An advantage of this embodiment over known use of button connectors, such as U.S. Pat. No. 8,496,503, is that a female portion is unnecessary, thus saving cost. According to the invention a cable is permanently connected via the holding portion 33, thus avoiding the risk of electrical disconnection, for example due to vibration in a vehicle. A further advantage of this invention over the use of a female portion of a known button connector is that axial rotation is completely eliminated, thus eliminating a source of fretting corrosion. Fretting corrosion is a source of radio frequency interference, which adversely affects other electrical equipment, for example a radio in a vehicle.

In another embodiment of the invention, the holding portion 33 is a spade or blade. A permanent connection is made by soldering a cable to the spade, used as a soldering lug. Alternatively, a releasable connection is provided for a cable terminated in a female portion of a spade connector.

Figure 17:
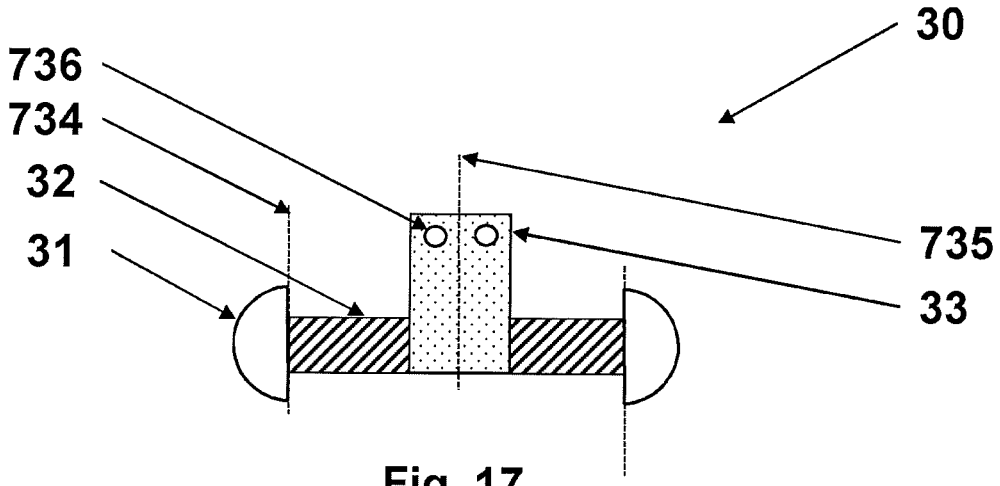
FIG. 17 shows a folded connector having a foot made of two semi-circles.
Figure 19:
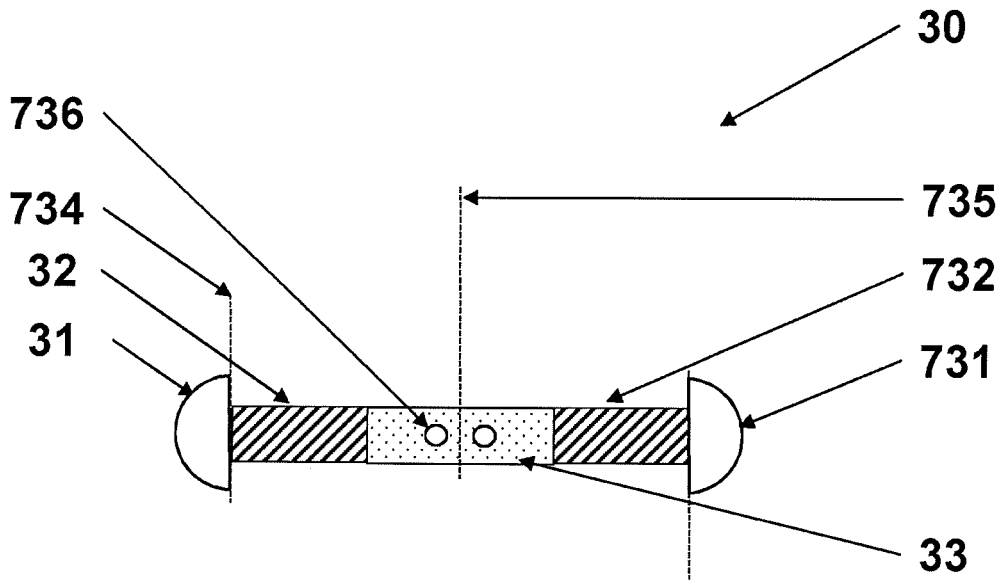
FIG. 19 shows a folded connector having a spade connector formed by a fold.
Figure 20:
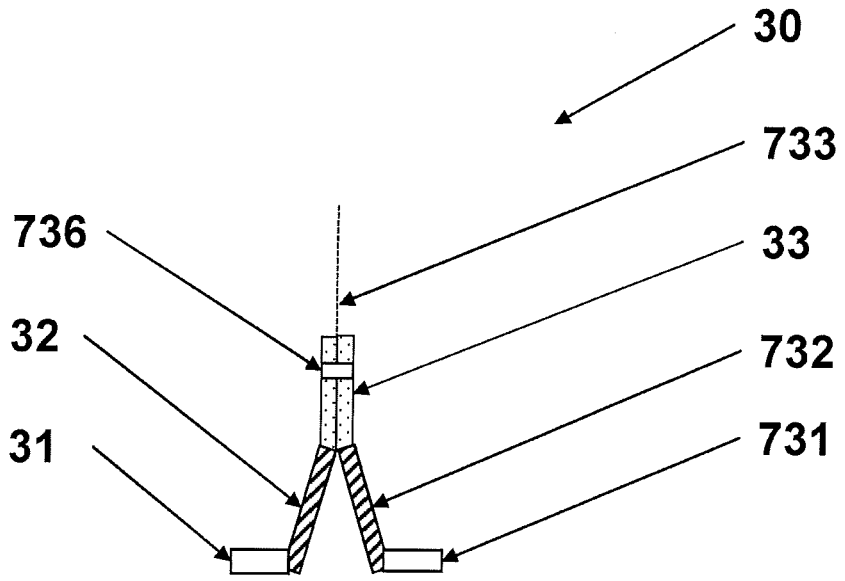
FIG. 20 shows a folded connector having first and second angled portions.

In an advantageous embodiment, as in FIG. 17, the holding portion 33, the angled portion 32 and the foot 31 are made from one piece of sheet metal with at least one fold 734 between the foot 31 and the angled portion 32. The foot 31 comprises two semi-circular halves. An additional fold 735 on the centre line of the holding portion 33 has the advantage that the resulting spade connector has double thickness, so is more robust. Sheet metal thickness is preferably 0.4 mm so that the holding portion 33 when folded has thickness 0.8 mm, compatible with a female portion of a known spade connector. At least one hole 736 is provided in the holding portion 33 to retain a spring clip on a female portion of a known spade connector. In FIG. 19 and FIG. 20, first and second angled portions 32, 732 are permanently connected to first and second feet 31, 731 and are substantially at right angles to the plane of the feet, such that first and second angled portions 32, 732 provide spring forces opposing movement of a holding portion 33. Surprisingly, the inventor has found that the embodiment of FIG. 20 is particularly effective in providing spring forces to oppose diagonal movement of the holding portion 33 relative to a plane 733, defined by the fold 735. Such spring forces are sufficient to relieve stress on lead-free solder joints, which attach first and second feet 31, 731 to an electrical conductor 21 on a surface of a sheet of glazing material 11. As a result, fewer breakages of glass in the region of the solder joints occur.

Figure 18:
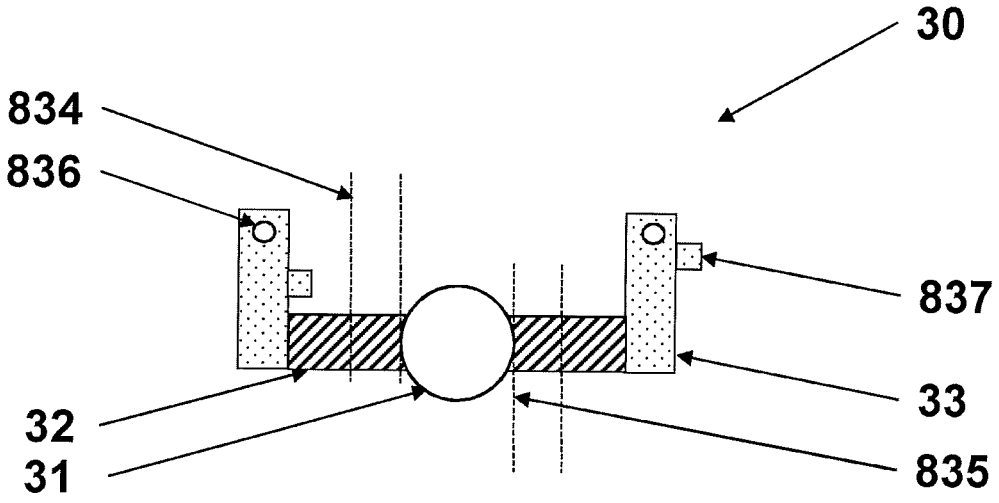
FIG. 18 shows a folded connector having clips.

In another advantageous embodiment, as in FIG. 18, the angled portion 32 comprises two parts, each connected to the foot 31. Each part of the angled portion 32 has a right angle fold 834 and a 180 degree fold 835, so that an upright part of the angled portion 32 is substantially at right angles to the plane of the foot 31. The holding portion 33 comprises two parts, each connected to a part of the angled portion 32. At least one hole 836 is provided in the holding portion 33 to retain a spring clip on a female portion of a known spade connector. Each part of the holding portion 33 further comprises a clip 837 suitable for clipping together the two parts of the holding portion 33 by folding the clip 837 on one part of the holding portion 33 over the other part of the holding portion 33.

Figure 3:
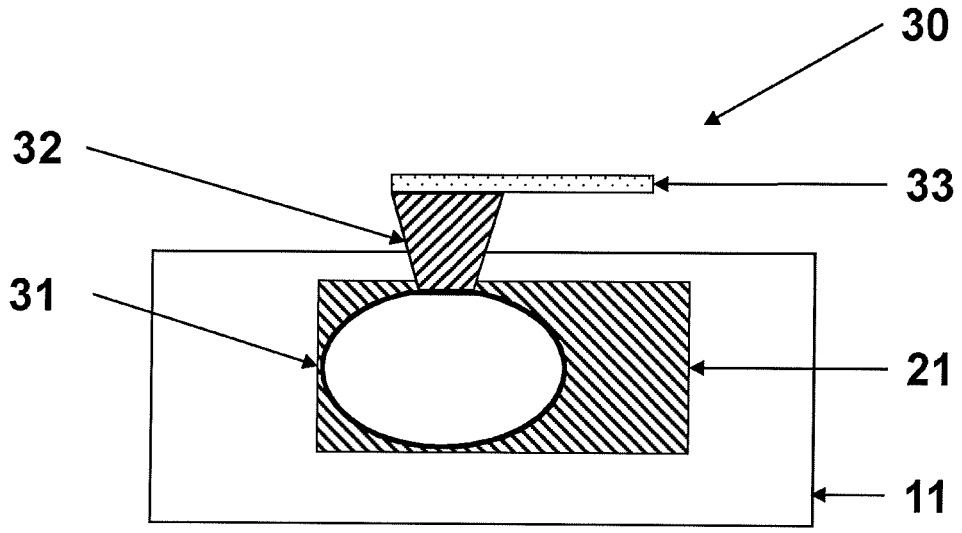
FIG. 3 shows a glazing according to the invention in plan view.
Figure 4:
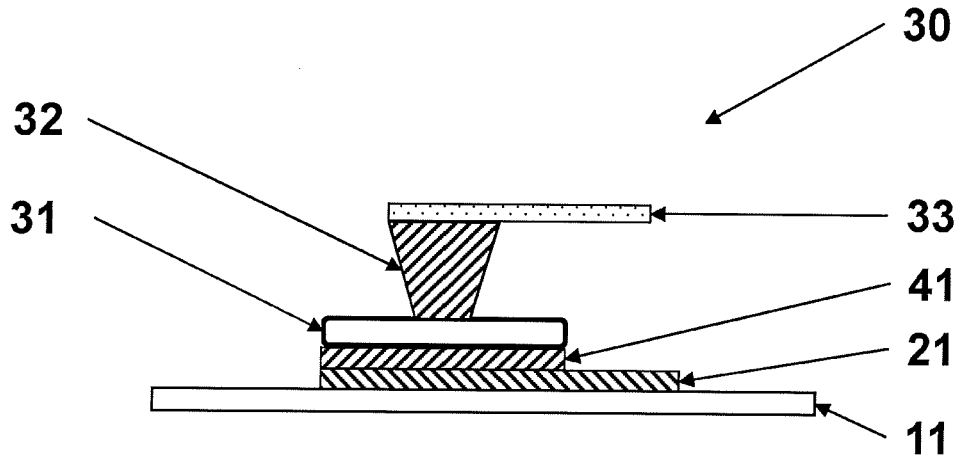
FIG. 4 shows a glazing according to the invention in side view.

In a preferred embodiment, shown in FIG. 3 and FIG. 4, a glazing 10 is provided comprising an electrical connector 30 according to the invention, the glazing further comprising a sheet of glazing material 11, an electrical conductor 21 on a surface of the sheet of glazing material 11, a solder layer 41 between the electrical conductor 21 and the foot 31 of the electrical connector 30, wherein the solder connector comprises lead-free solder.

The electrical conductor 21 is, for example, a busbar of a heating circuit in a vehicle glazing.

Lead-free solder is a solder composition avoiding the use of lead, for example tin-silver solders, tin-bismuth solders and tin-indium solders known in the art.

In an advantageous embodiment, a glazing 10 further comprises a cable, wherein the holding portion is connected to the angled portion 32 close to the foot 31 and the cable is welded to the holding portion 33. Alternatively the cable may be soldered to holding portion 33. The holding portion 33 may be a washer welded to the angled portion 32.

According to the invention from a second aspect, a method of manufacturing a glazing is disclosed, comprising the steps of:

providing a sheet of glazing material 11 providing an electrical conductor 21 on a surface of the sheet of glazing material 11 fixing an electrical connector 30 according to the invention to the electrical conductor 21 by applying a solder layer 41 therebetween, wherein the solder layer 41 is lead-free solder.

In a preferred method according to the invention, the holding portion 33 is a washer and a cable is soldered to the washer at the same time as the washer is soldered to the angled portion 32. The washer is a thin flat plate, typically a steel disc, preferably having an outer diameter less than or equal to twice an inner diameter. An example washer has inner diameter 6.4 mm, outer diameter 12 mm and thickness 1.6 mm. In a preferred embodiment of the invention, the inner diameter of the washer is selected to fit an outer diameter of a substantially cylindrical angled portion 32, which is a male portion of a button connector. Preferably, the male portion of the button connector is a male portion of a PP3 snap connector, as used by Ever Ready in the Power Pack series for a 9 volt battery.

The invention claimed is:

1. An electrical connector comprising:

a foot, substantially planar and of a material suitable for soldering;

an angled portion, permanently connected to the foot and substantially at right angles to the plane of the foot;

a washer, connected to the angled portion and suitable for holding a cable, the washer being a flat disc; and the foot being substantially circular or oval in shape.

2. An electrical connector according to claim 1, wherein the angled portion is substantially cylindrical in shape.

3. An electrical connector according to claim 2, wherein the washer is soldered or welded to the angled portion.

4. An electrical connector according to claim 2, wherein the angled portion further comprises a ledge to define the position of the washer.

5. An electrical connector according to claim 1, wherein the angled portion is a male portion of a button connector, having a cylindrical conical shape, wherein the part of the angled portion close to the foot is not as wide as the part of the angled portion remote from the foot and the washer is permanently connected to the angled portion.

6. A glazing comprising an electrical connector according to claim 1, the glazing further comprising:

a sheet of glazing material;

an electrical conductor on a surface of the sheet of glazing material; and a solder layer between the electrical conductor and the foot of the electrical connector wherein the solder layer comprises lead-free solder.

7. A glazing according to claim 6, further comprising a cable, wherein the washer is welded to the angled portion and the cable is soldered to the washer.

8. A method of manufacturing a glazing comprising:

providing a sheet of glazing material;

providing an electrical conductor on a surface of the sheet of glazing material; and fixing an electrical connector according to claim 1 to the electrical conductor by applying a solder layer between the electrical connector and the electrical conductor, wherein the solder layer is lead-free solder.

9. A method of manufacturing a glazing according to claim 8, wherein a cable is soldered to the washer at the same time as the washer is soldered to the angled portion.

10. An electrical connector comprising:

a foot having a planar shape and being made of a solderable material;

a cylindrical angled portion permanently connected to the foot at a substantially right angle to a plane of the foot, the angled portion being substantially cylindrical in shape; and a washer connected to the cylindrical angled portion and suitable for holding a cable, the washer having an outer diameter and an inner diameter, the inner diameter of the washer being greater than or equal to an outer diameter of the cylindrical angled portion.

11. An electrical connector according to claim 1, wherein the washer has a through-hole.

12. An electrical connector comprising:

a foot having a planar shape and being made of a solderable material;

an angled portion permanently connected to the foot at a substantially right angle to a plane of the foot; and a thin flat plate connected to the angled portion and suitable for holding a cable.

13. An electrical connector according to claim 12, wherein the thin flat plate has an inner diameter and an outer diameter.

14. An electrical connector according to claim 13, wherein the inner diameter of the thin flat plate is selected to fit an outer diameter of the angled portion.

15. An electrical connector according to claim 12, wherein the angled portion comprises a ledge which defines a position of the thin flat plate.

16. An electrical connector according to claim 15, wherein the thin flat plate is directly above the ledge.

17. An electrical connector according to claim 15, wherein the thin flat plate rests on the ledge.

18. An electrical connector according to claim 12, wherein the thin flat plate is soldered or welded to the angled portion.

* * * * *